US005845579A

United States Patent [19]

Langley et al.

[11] Patent Number: 5,845,579

[45] Date of Patent: Dec. 8, 1998

[54] MOVABLE THRESHOLDS AND RAILWAY PLATFORM BARRIER DOORS

[75] Inventors: Keith William Langley, Bath; Russell Clinton Harding, Colerne; Derek Tate, Melksham; Mark Andrew John Hemmings, Chippenham, all of England

[73] Assignee: Westinghouse Brake and Signal Holdings Limited, Chippenham, Great Britain

[21] Appl. No.: 617,913

[22] PCT Filed: Jul. 25, 1995

[86] PCT No.: PCT/GB95/01750

§ 371 Date: Jul. 15, 1996

§ 102(e) Date: Jul. 15, 1996

[87] PCT Pub. No.: WO96/03302

PCT Pub. Date: Feb. 8, 1996

[30] Foreign Application Priority Data

Jul. 26, 1994 [GB] United Kingdom ..... 9415016

[51] Int. Cl.[6] ..... B61B 1/02

[52] U.S. Cl. ..... 104/31; 14/71.1

[58] Field of Search ..... 104/28, 30, 31; 105/341, 341.5, 436; 14/71.1, 72.5

[56] References Cited

U.S. PATENT DOCUMENTS

| | | | |
|---|---|---|---|
| 937,375 | 10/1909 | Logan . | |
| 1,149,759 | 8/1915 | Hedley et al. | 104/31 |
| 1,216,560 | 2/1917 | Gallinant | 104/31 |
| 5,253,589 | 10/1993 | Kawanishi et al. | 104/28 |

FOREIGN PATENT DOCUMENTS

| | | |
|---|---|---|
| 2 575 984 | 7/1986 | France . |
| 27 12 927 | 9/1978 | Germany . |
| 3132296 | 3/1983 | Germany . |
| 1034411 | 6/1966 | United Kingdom . |
| 2 066 768 | 7/1981 | United Kingdom . |
| 2 102 377 | 2/1983 | United Kingdom . |
| 2 223 211 | 4/1990 | United Kingdom . |
| 2 291 034 | 1/1996 | United Kingdom . |
| WO 93/25763 | 10/1995 | WIPO . |

*Primary Examiner*—S. Joseph Morano
*Attorney, Agent, or Firm*—Marshall, O'Toole, Gerstein, Murray & Borun

[57] ABSTRACT

Thresholds for bridging the gap between a platform and doorways of vehicles stopped at the platform. The thresholds are adapted to move from a retracted position to an extended position in response to the opening of barrier doors mounted alongside the platform.

11 Claims, 10 Drawing Sheets

1
2
3
4
5
6
12
13
14
14A
14B
15
16
17

1
2
3
4
5
6
19
20
21
22
23

SYSTEM BLOCK DIAGRAM FIG. 15

GROUP BLOCK DIAGRAM

MOVABLE THRESHOLDS AND RAILWAY PLATFORM BARRIER DOORS

This invention relates to thresholds for platforms from or to which people or goods move in embarking or disembarking into or from vehicles stationary at the platforms, especially in railway systems.

As prior art, there may be mentioned GB-A-2 223 211; GB-A-2 102 377; GB-2 066 768; GB-A- 1 034 411; WO 93/25763; and U.S. Pat. No. 4,825,493.

For enhancing the railway travelling public's environment and safety, screens are provided on the edges of platforms to provide a barrier between waiting passengers and moving trains, doors being provided in these screens at appropriate locations to be in line with the access doors of a train at halt in the station.

Where a platform is straight, the rails adjacent thereto can be set to provide a relatively small distance between train and platform edge so the gap between the train door thresholds and the platform edge is small enough to prevent passengers' feet from being trapped. Where a platform is curved, however, a very significant gap is necessary between the train door thresholds and the platform edge to provide sufficient clearance for trains to negotiate the curve, creating a potential danger to passengers who have to cross this gap.

According to the present invention there is provided a threshold arrangement for bridging the gap between a platform edge and a door threshold of a vehicle stationary at the platform, the arrangement comprising a movable threshold supported by the platform and means for moving this threshold to and fro between a withdrawn position in which sufficient clearance is provided for the vehicle to draw up beside the platform edge and an extended position in which this threshold substantially bridges the gap between the platform edge and the vehicle door threshold.

The platform may have a barrier along the edge of the platform with a door in it, which door opens when a vehicle has drawn up beside the platform edge, the movable threshold in its extended position bridging the gap at the door opening.

The movable threshold may be coupled for movement in conjunction with opening and closing movement of said door in the barrier.

The movable threshold may be supported for movement from beneath a fixed threshold of the platform (the withdrawn position of the movable threshold) to form an extension of the fixed threshold (the extended position of the movable threshold).

In a preferred example, the moving means comprises an electric actuator.

Figures 1, 2:
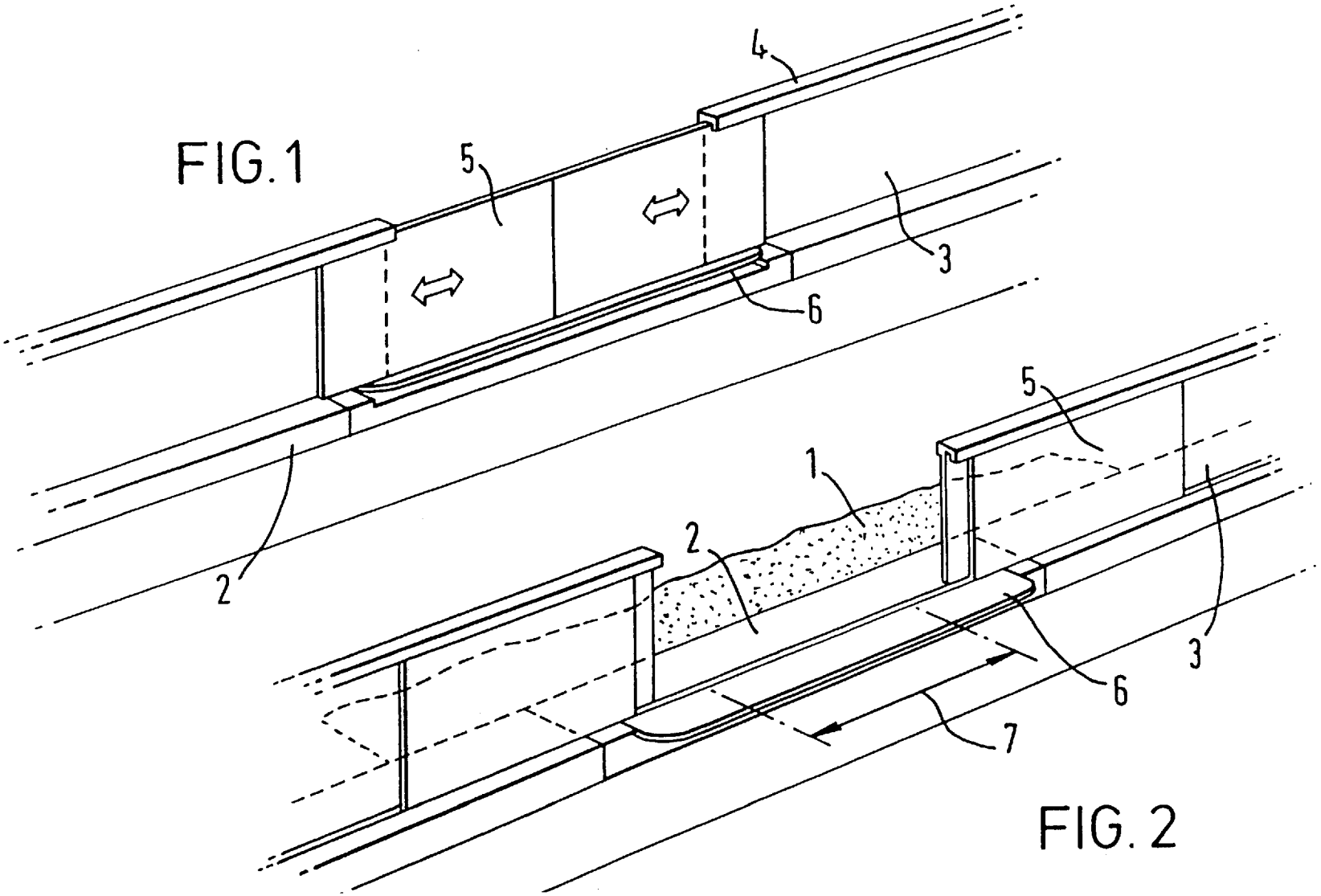
Figures 3, 4:
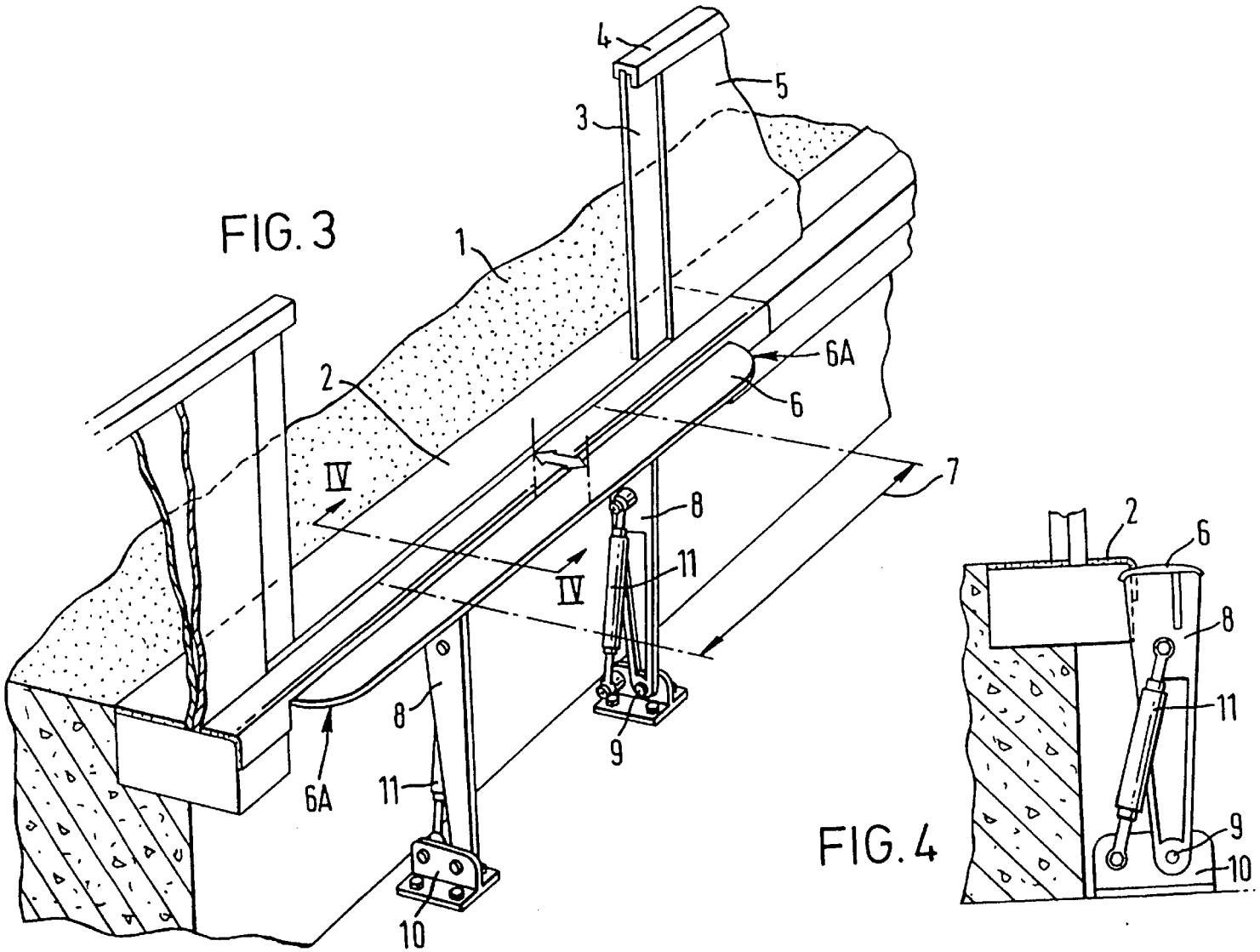
Figures 5, 6, 7:
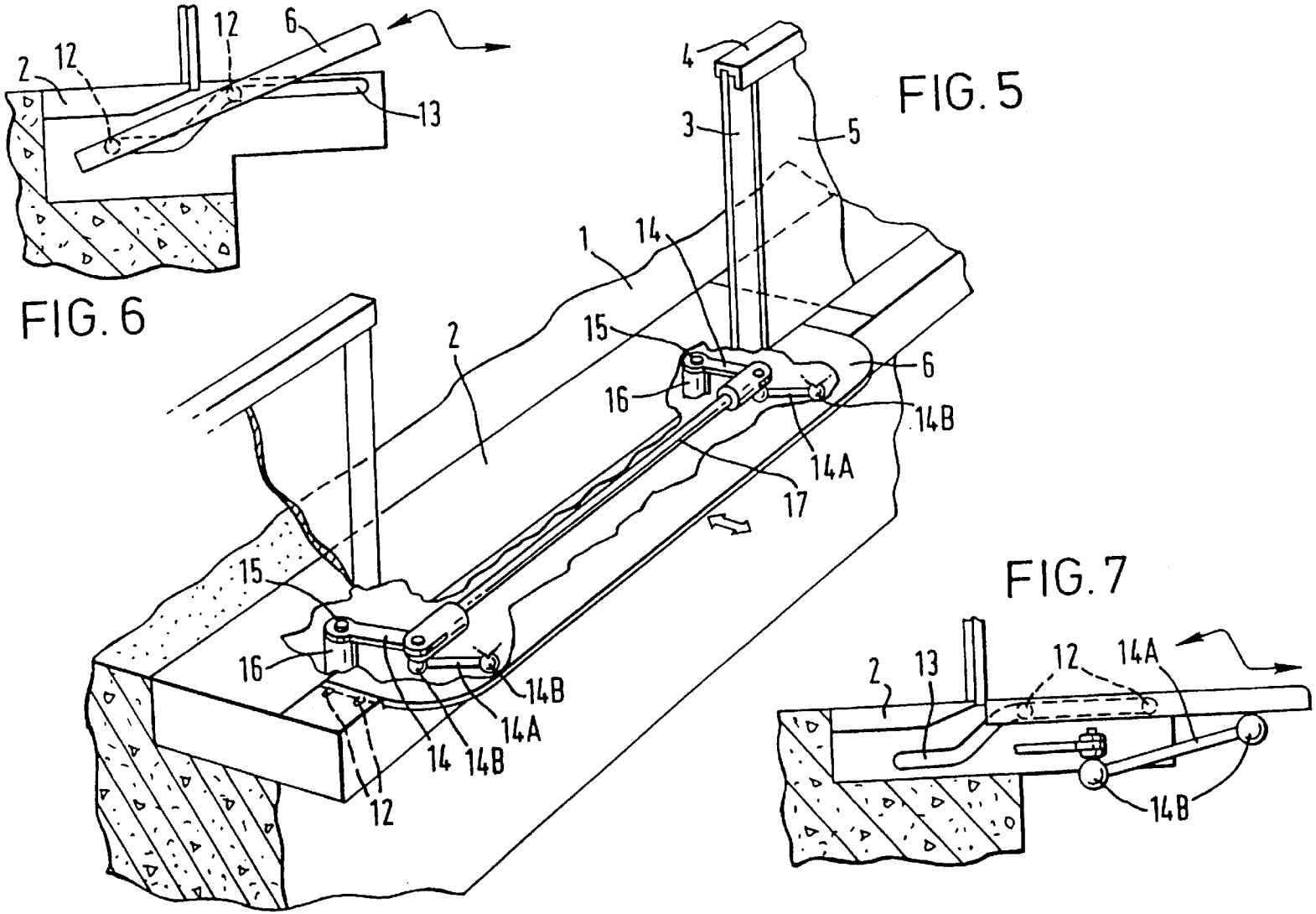
Figure 8:
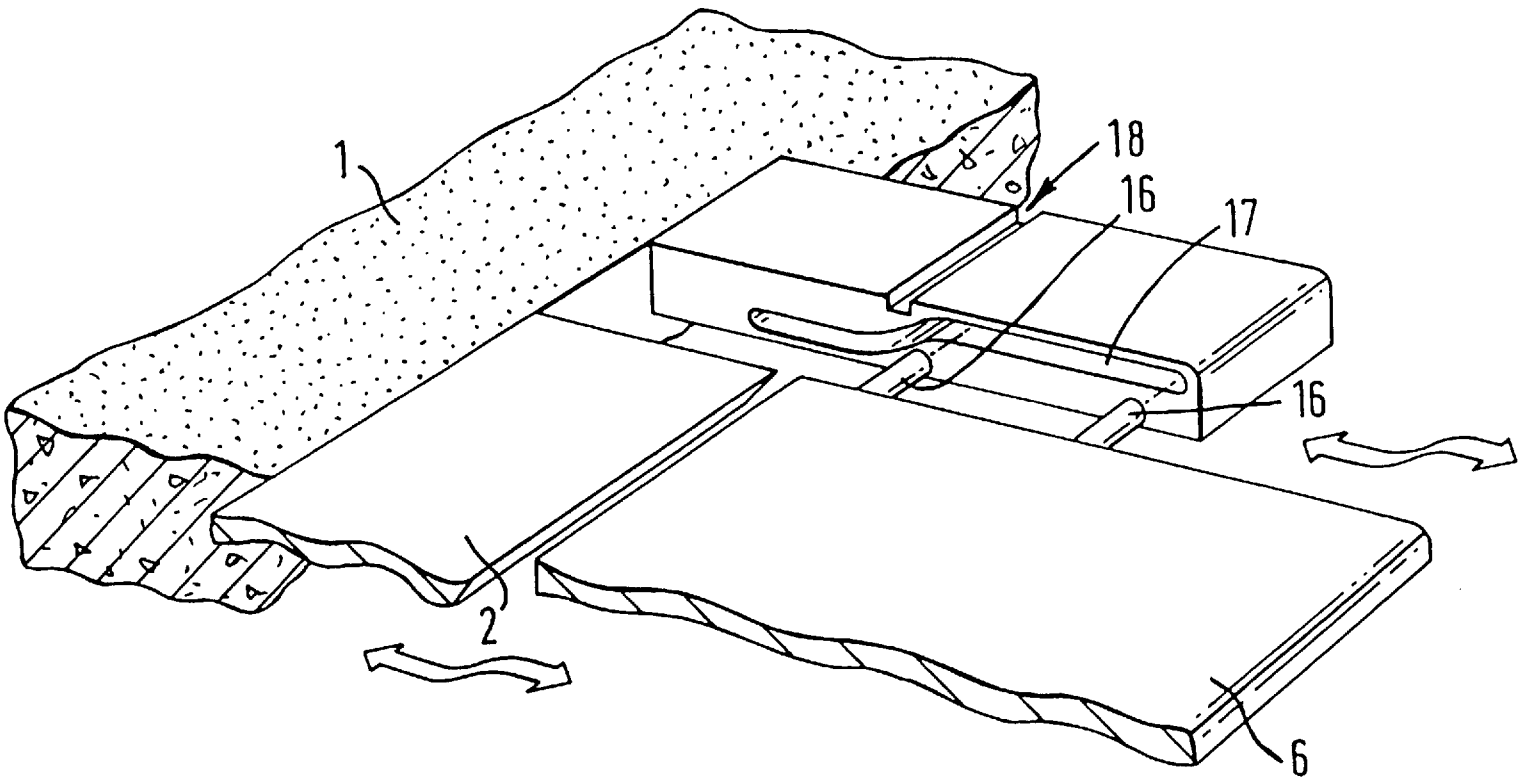
Figures 9, 10, 11:
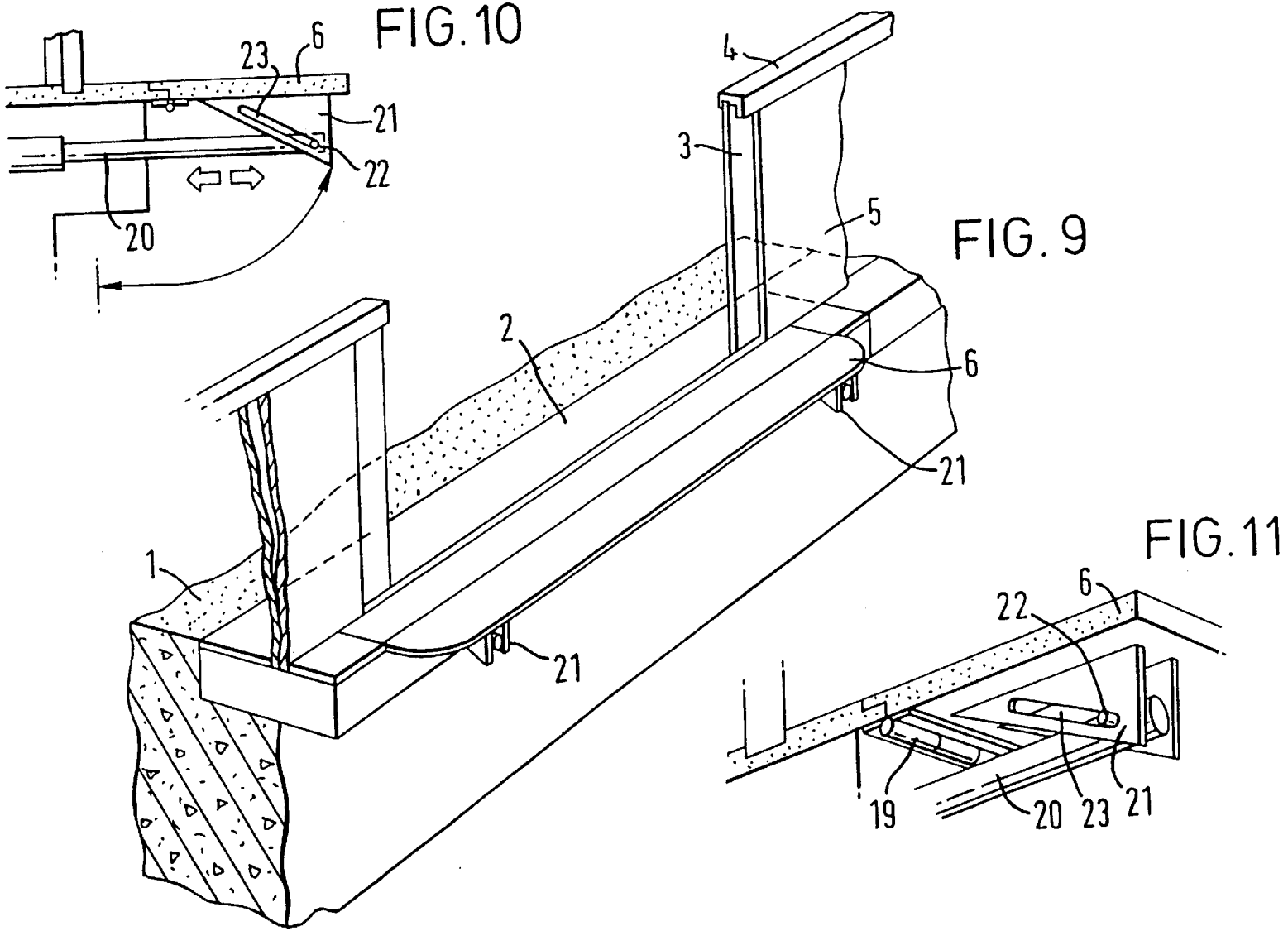
Figure 12:
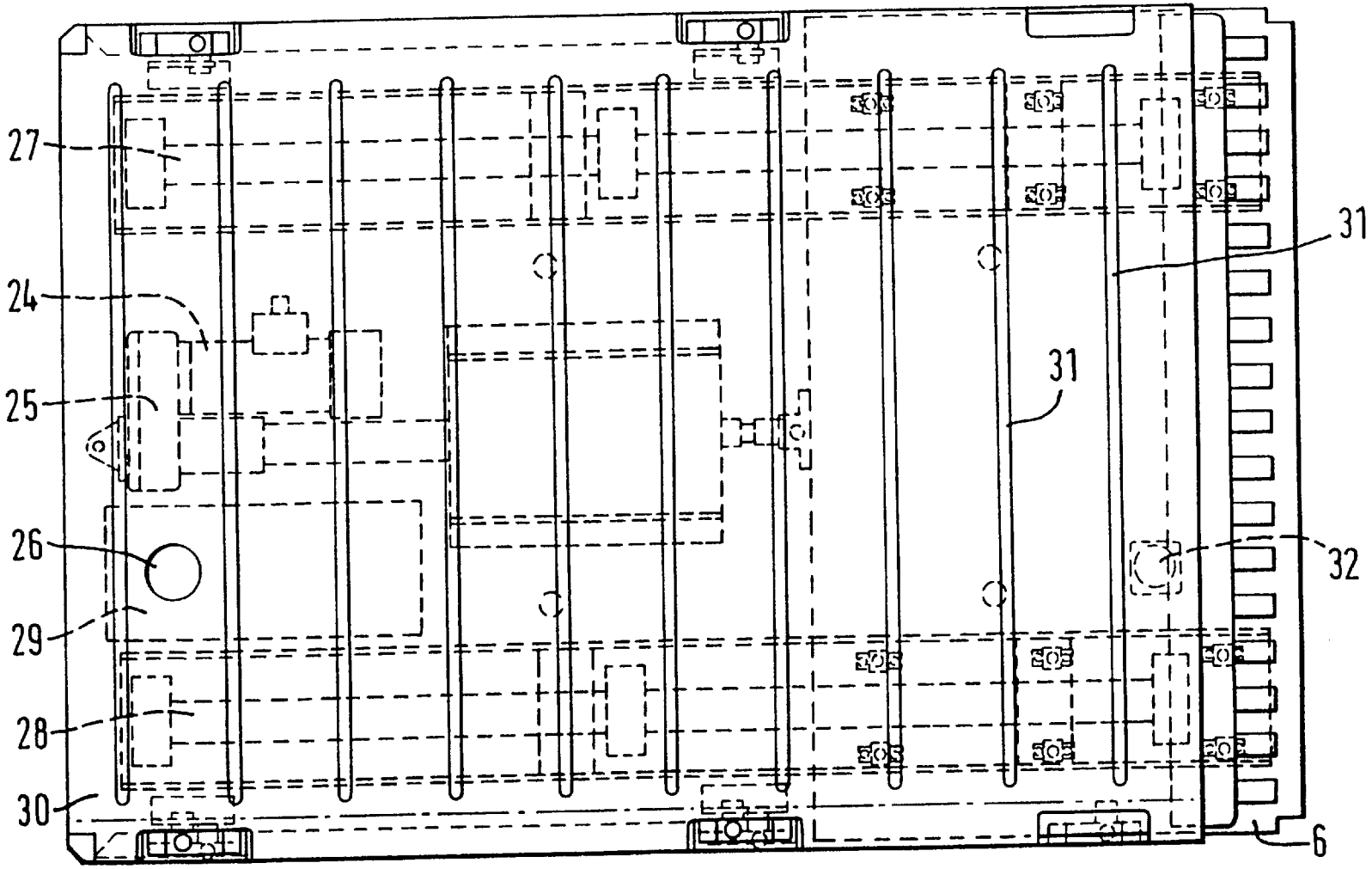
Figure 13:
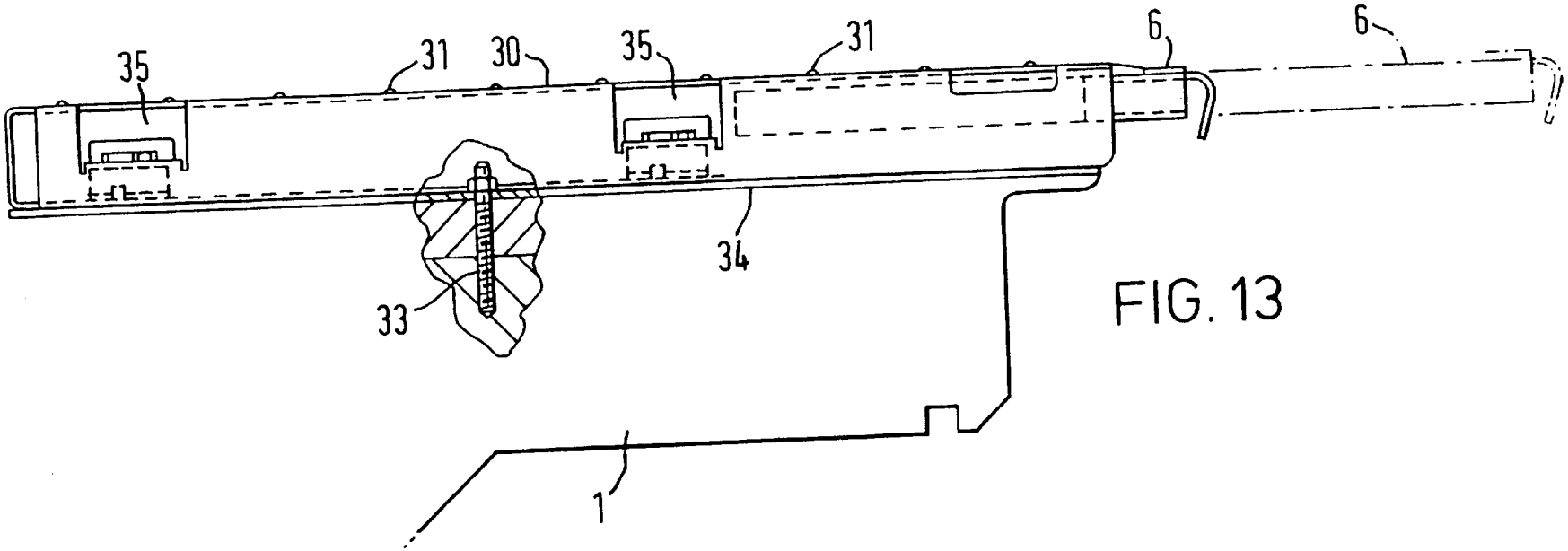
Figure 14:
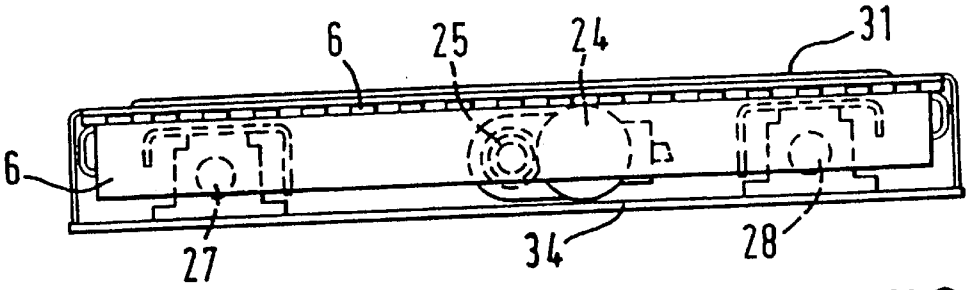

For a better understanding of the invention and to show how the same may be carried into effect, reference will now be made, by way of example, to the accompanying drawings, in which:

FIG. 1 shows a platform barrier with sliding doors therein closed and a movable threshold at the base of the doors in withdrawn position, FIG. 2 shows the barrier of FIG. 1 with its sliding doors open and the movable threshold in extended position, FIG. 3 shows, on a larger scale, the barrier doors of FIGS. 1 and 2 in open position, a first form of mechanism for moving the movable threshold being illustrated, FIG. 4 is a sectional view taken on line IV—IV in FIG. 3, FIG. 5 shows, on a larger scale, the barrier doors of FIGS. 1 and 2 in open position, a second form of mechanism for moving the movable threshold being illustrated, FIG. 6 is a side view showing the movable threshold of FIG. 5 in withdrawn position (sliding doors closed), FIG. 7 is a side view showing the movable threshold of FIG. 5 in extended position (sliding doors open), FIG. 8 is a detailed view illustrating the second form of mechanism for moving the movable threshold, FIG. 9 shows, on a larger scale, the barrier doors of FIGS. 1 and 2 in open position, a third form of mechanism for moving the movable threshold being illustrated, FIG. 10 is a side view showing the movable threshold of FIG. 9 in extended position (sliding doors open), FIG. 11 is a detail view of the third form of mechanism for moving the movable threshold, FIG. 12 is a plan view of a movable threshold according to a preferred example of the present invention, FIG. 13 is a side view of what is shown in FIG. 12, FIG. 14 is an end view in the direction of the platform of what is shown in FIG. 12 and FIGS. 15, 16 and 17 are schematic block diagrams of control circuitry for a system using thresholds according to FIGS. 12, 13 and 14.

Throughout the Figures like components are indicated by like references.

Referring first to FIGS. 1 and 2, along a platform 1 there is a fixed threshold 2 that supports a barrier 3 that is capped by a hand rail 4. Sliding barrier door pairs 5 disposed to be opposite the entrance/exit doors of a train stationary at the platform are shown closed in FIG. 1 and open in FIG. 2. At the location of each door pair 5 that is at a curved run of the platform (for ease of drawing the platform, the barrier and its doors and the fixed threshold are shown straight in the Figures) a movable threshold 6 is provided for cooperation with the train doors, the fully open width of which is shown at 7. Where the platform is curved to follow a curve in the track (and the barrier and its doors and the fixed threshold also follow this curve), a very significant gap is necessary between the train door thresholds and the opposing edge of the platform fixed threshold to give sufficient clearance to permit trains to negotiate the curve. The movable threshold 6 in extended position substantially bridges this gap. Various forms of mechanism for moving the movable threshold will now be described.

Referring to FIGS. 3 and 4, the movable threshold 6 is mounted below the fixed threshold 2 supported by arms 8 upstanding from pivotal attachments at 9 to brackets at 10 secured at the base level of the platform 1, that is at track level. As shown in FIGS. 3 and 4 the arms 8 are driven to pivot by hydraulic piston and cylinder arrangements 11 but this drive could alternatively be by pneumatic or electric power.

In FIGS. 3 and 4 the movable threshold 6 is shown in extended position in which it substantially bridges the gap between the fixed threshold 2 and a train (not shown) standing at the platform, the movable threshold 6 being a little below the level of the fixed threshold 2. Pivoting of the arms 8 anticlockwise as viewed in FIG. 4 swings the movable threshold 6 so that it withdraws below the fixed threshold 2. Drive movement of the arms 8 is interlocked by mechanism (not shown) with opening and closing movement of the sliding barrier doors 5. The ends of the movable threshold 6 are profiled at 6A to ensure that trains approaching the platform will push the extended movable threshold back towards its withdrawn position in the event of drive mechanism malfunction.

In the form of FIGS. 5, 6, 7 and 8 the movable threshold 6 in extended position is at the level of the fixed threshold 2, as shown best in FIGS. 7 and 8. To achieve this the movable threshold 6 is supported from the fixed threshold 2 by pins 12, each end of which are guided within tracks 13. The movable threshold 6 is moved backwards and forwards by sympathetic pivotal movement of horizontal arms 14 extending from upright pivot shafts 15 driven by motors 16 which can be electrically, pneumatically or hydraulically operated. The ends of the arms 14 remote from their shafts 15 are pivotally connected together by a tie rod 17 beyond which swivel jointed links 14A pivotally link the arms 14 to the underside of the threshold 6, there being ball swivel joints 14B at each end of each link 14A.

The pins 12 both support the movable threshold and guide it so that from its horizontal extended position flush with the upper surface of the fixed threshold 2, the movable threshold 6 tilts and moves down under the fixed threshold 2, tilting back to a horizontal position as it reaches its fully withdrawn position below the fixed threshold 2. Alternatively a mechanism other than the pivoting arm, tie rod and link mechanism just described could be provided for effecting reciprocation of the movable threshold 2 with tilting motion as just described.

In FIG. 8, a door runner track in the fixed threshold 2 for the sliding barrier doors is shown at 18.

In the form illustrated in FIGS. 9, 10 and 11 the movable threshold 6 is mounted along the front edge of the fixed threshold 2 at a horizontal hinge 19 that runs along the fixed threshold 2. Actuating piston and cylinder arrangements 20 at each end of the movable threshold 6 extend from inner pivotal mounting points (not shown) to brackets 21 carried by the movable threshold 6. Pins 22 of the piston and cylinder arrangement 20 are engaged in slots 23 in the brackets 21. In an extended condition the arrangements 20 support the movable threshold in its extended position flush with the fixed threshold 2, as shown in FIGS. 9, 10 and 11.

Upon contraction of the piston and cylinder arrangements from the extended position shown, the pins 22 slide along the slots 23 and cause the movable threshold 2 to pivot down about the hinge 19. Thus the movable threshold 2 can be pivoted down from the extended position flush with the fixed threshold 2 shown in FIGS. 9, 10 and 11 to a downwardly hanging withdrawn position (not shown).

An approximately waist high barrier 3 is depicted but the barrier and its doors could be to ceiling height.

There will now be described a preferred example of the present invention, in the form of an electrically actuated movable threshold for use with a platform barrier with sliding doors as shown in FIGS. 1 and 2, and a platform edge system including a plurality of such thresholds. In the platform edge system there are the following items:

- Platform edge units—these are moving edge gap fillers, each including a movable threshold according to the preferred example of the invention.
- Unit concentrators—these units consolidate the control and monitoring signals to a group of platform edge units and include wiring terminations.
- Secure supply system—this includes a battery backed supply system and supply control switches.
- Control panel—this panel includes an interface between an existing barrier doors control system and the platform edge system and enables the edge (threshold) drive and controls the direction of edge movement and also incorporates a monitoring system which the user can interrogate if required.

Platform edge units

Each platform 1 is provided with 300 edge units, each unit being 750 mm wide. Each edge unit (see FIGS. 12, 13 and 14) is driven both out and in using a small AC motor 24 in each unit. Synchronous AC motors have been chosen to minimise maintenance as they are the simplest devices having no brushes.

The moving part (the moving edge or threshold 6) is driven by a linear actuator 25 or direct motor driven ball screw until a limit switch detects the correct position has been reached. The out (extended) position (shown in broken lines in FIG. 13) is manually adjustable so that the edge can be set according to the gap to be filled. This ensures the edge units are common to all positions. It is anticipated that a full stroke will be completed by the motor in 1.5 to 2 seconds.

Each AC motor 24 incorporates an electrically driven friction brake which will hold the edge unit in its stationary position. This brake is actuated by the loss of its AC drive.

Each unit contains a small red and green display 26 visible from the above. When the unit is in a fixed position, the green lamp will be lit. At all other times, the red lamp will be lit. It is intended that if a fault occurs then station staff will be quickly able to identify the problem group from the control panel and then the lamps will indicate the problem unit in the group.

In FIGS. 12, 13 and 14, reference numerals 27 and 28 denote linear bearings for the moving edge or threshold 6; reference numeral 29 denotes the platform edge gap filler controller; reference numeral 30 denotes a stainless steel cover of the unit, having ribs 31 to provide an anti-slip surface; reference numeral 32 denotes an electrical connection multi-pin connector to the unit concentrator; reference numeral 33 denotes one of various bolts fixing the base 34 of the unit to the platform 1; and reference numerals 35 denote pockets to provide lifting points for the unit.

Unit concentrators

For each group of edge units, a unit concentrator is provided. This unit may be a panel which fits on the facing edge of the platform below the edge units. The concentrator provides terminations for the system control busses and three phase supply. The concentrator passes the control signals on to each edge unit via a set of wire leads. The leads are terminated with connectors at the edge unit end to enable rapid replacement.

The concentrator includes a key switch operated isolating switch on its face which should be positioned so that it can be reached from the platform edge.

The concentrator groups the edge position signals to produce ALL GROUP OUT and ALL GROUP IN signals, these signals, in the form of volt free contacts, being looped with the other concentrator signals to form the system signals ALL EDGES OUT and ALL EDGES IN.

Within the concentrator is a microprocessor based unit which monitors the status of the edge units. This unit communicates with the central control panel indicating the status of each edge unit via a serial communication link.

The concentrator includes an audio slave unit to give warning that the platform edge is moving. The warning continues for as long as both the ALL GROUP OUT and ALL GROUP IN signals indicate that at least one of the local edges in the group is not in position. This warning may be either a tone or a voice announcement for example. The warning may be driven by a common signal from the control panel to give a clear in-phase message down the platform.

Secure supply system

The system as a whole is powered by an uninterruptible supply (UPS). This form of supply has been chosen to provide a battery backed AC supply. Incorporating a secure supply enables each edge block to be simplified to a maintenance free AC motor which drives in both directions. The supply ensures that if the station supply is lost, internal batteries will continue to power the system so that the edge can always be returned to the in position, minimizing the possibility of the edge being stuck out allowing train operation to continue. If required, the system can be configured to either not operate (other than to return the edge to the closed position) when the station supply has failed or to continue operation while the UPS batteries remain operational.

A bypass is included so that in the event of failure in the UPS the platform edges can be returned to the in position.

Control panel

The control system includes control and monitoring networks. These consist of:

Primary control monitoring signals on a platform basis. For example DRIVE OUT and ALL EDGES OUT. These control signals are implemented in hardware.

Secondary level monitoring which is a software system designed to help in identifying which, if any, edge has failed and to gather some maintenance data for preventive maintenance.

The control panel contains all the controls to interface between an existing system and the edge system. This panel provides the movement and direction control for the edge system. It monitors the status of the edges and indicates to the existing system, either by lamps positioned appropriately or directly onto the train via a transmission unit.

This panel also gathers data from the system for maintenance or to help with fault detection. A user may interrogate the panel using an incorporated keypad or via a laptop computer.

The panel includes a system warning unit. This may be (as mentioned above) either a tone or voice announcement and will be sent to all concentrators.

Grouping sizes

The edges have to be grouped so that each doorway at least is covered by a single concentrator to avoid a disaster of half a door gap being filled due to concentrator failure.

Figure 15:
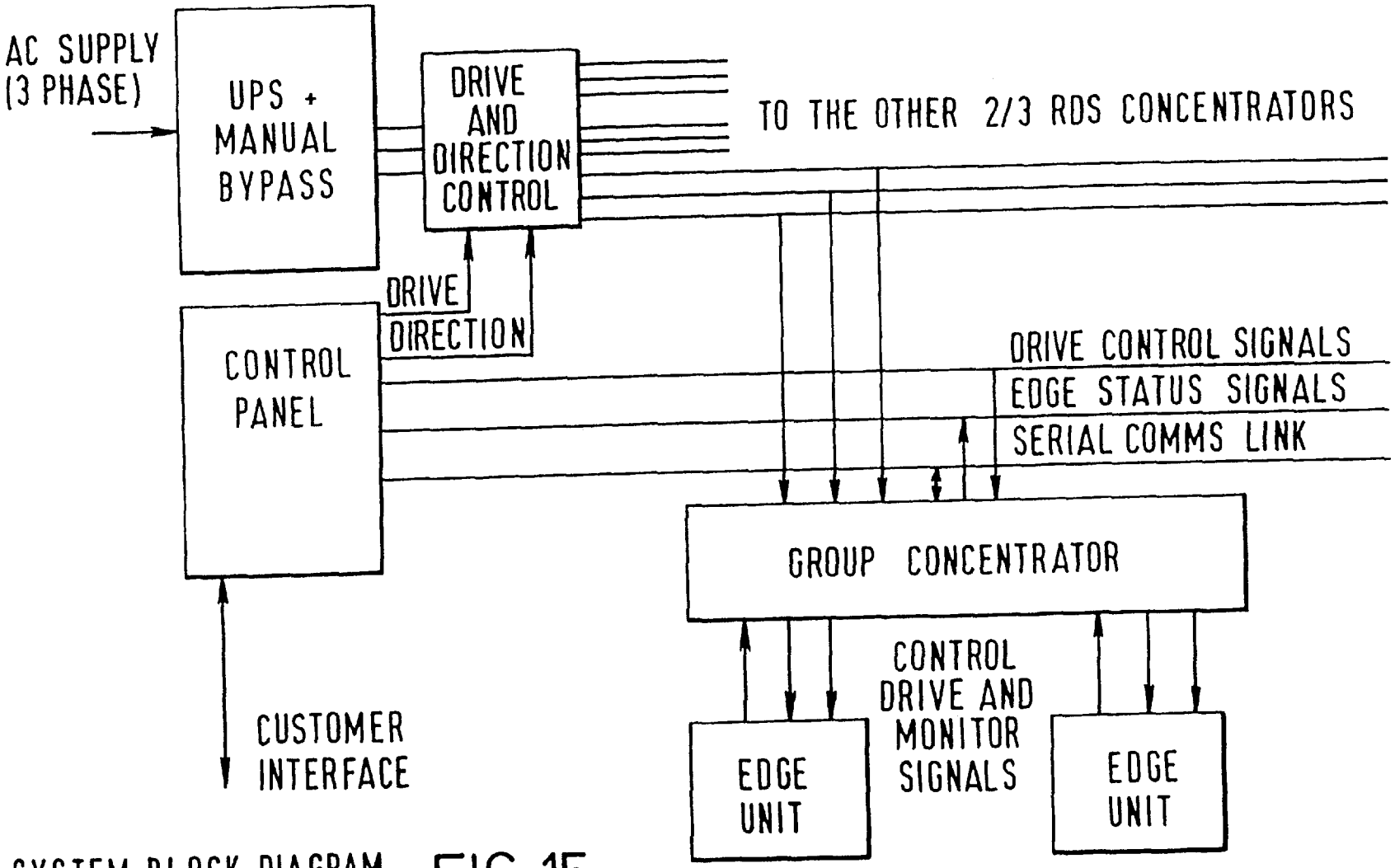
Figure 16:
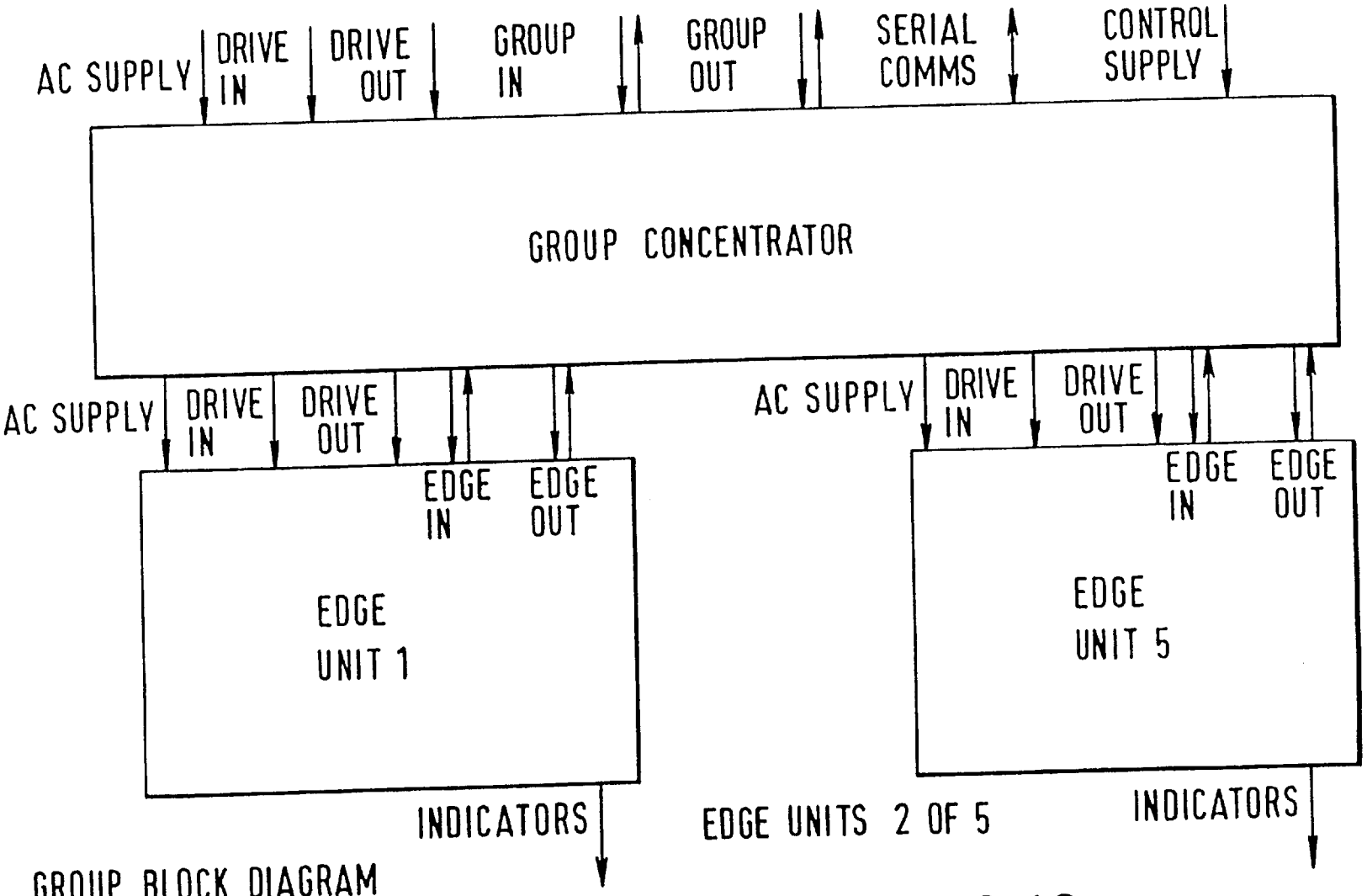
Figure 17:
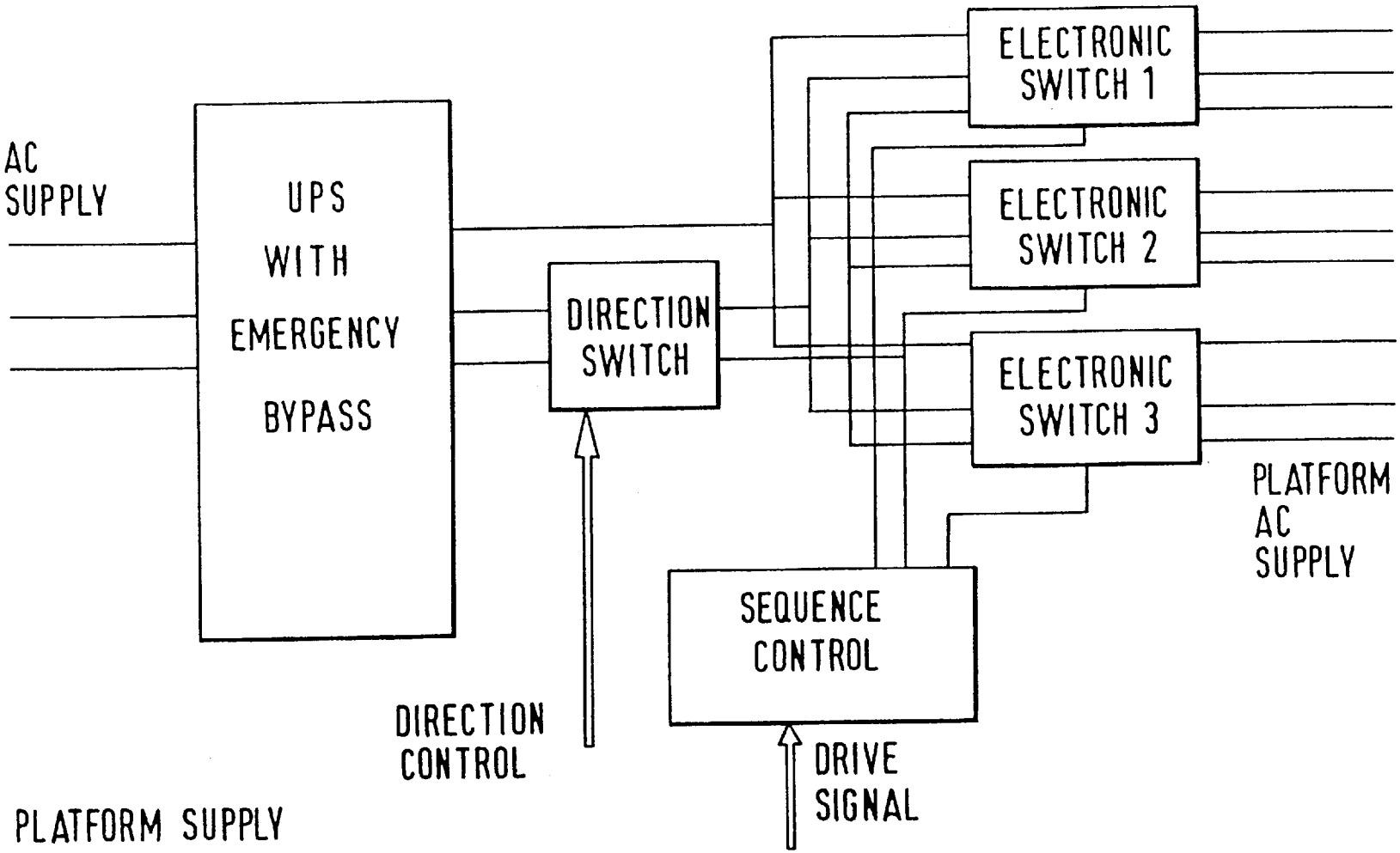

FIG. 15 is a system block diagram, FIG. 16 is a group block diagram and FIG. 17 is a platform supply block diagram.

Operation

When the control panel receives the signal to move the platform edges out, the direction contactor is driven so that two of the phases of the main drive are set. Consequently any movement by the AC motors will cause the edges to move out. At the same time, the drive out control signal will be sent to each edge unit. A high frequency sine wave may be used, and with suitable transformer coupling the signal is used directly to power the electronic switches (Triacs) in each edge unit. After a short delay, the main electronic switches in the supply system are powered to provide system power to the edge motors. Synchronous motors have a large starting current i.e. typically 200% of normal operating current, so it is envisaged that there will be three sets of power switches each driving one third of the platform. The first set switch on and after a few cycles and then the second set followed by the third set are powered. This spreads the starting surge over ten to fifteen cycles.

Each edge unit will drive out until the local limit switch is reached, the contact will open and power to the local electronic switches cut. This will cause the brake to activate and the motor to stop. A separate contact on the limit switch will indicate to the unit concentrator that the edge is now fully out. All the group limit switch contacts are in a loop forming drive to the unit concentrator relay. When all the edges are out the relay will be energized and the ALL GROUP OUT contact will be made. All the concentrator contacts are in a double cut loop. When all these contacts are made the ALL EDGES OUT signal will be made. At this point the main electronic switches can be turned off. If the signal is lost then power is re-applied until it is again made.

When the interface with the existing system indicates that the edges should be withdrawn, the supply contactor is set to reverse two of the phases. The high frequency "move in" signal is sent to all the edges via their concentrators to energize the local motors after a short delay the supply power switches are energized in sequence again and the edges move back. When each edge is fully in the in limit switch is tripped and the motor supply lost and the brake is applied. Each concentrator will energize its ALL EDGES IN signal when all the group are in. When all of the edges are in the system ALL EDGES IN signal will be energized at the control panel. From here the SAFE TO PROCEED signal will be sent to the interface.

Although specific description has been made with reference to railway platforms it is to be understood that the moving thresholds and driving mechanisms therefor described can be utilized wherever there is a platform from or to which people or goods move in embarking or disembarking into or from vehicles stationary at the platform and where it is desired to bridge a gap between platform and vehicle.

In all cases, the gap may be at a curved run of platform, or it can be at a straight run where, for reasons other than the curve of the platform, there is a gap between platform and vehicle which requires to be bridged.

We claim:

1. A combination of a platform having a platform edge and a threshold arrangement for bridging a gap between the platform edge and a door threshold of a vehicle stationary at the platform, wherein said arrangement comprises: a moveable threshold supported by the platform, the moveable threshold being provided with moving means for moving the moveable threshold to and fro between a withdrawn position in which sufficient clearance is provided for the vehicle to draw up beside the platform edge and an extended position in which the moveable threshold substantially bridges the gap between the platform edge and the vehicle door threshold; and control means for controlling movement of said moveable threshold via said moving means, wherein said platform has a barrier along said platform edge with a platform door in the barrier, which platform door opens when a vehicle has drawn up beside the platform edge, the moveable threshold in its extended position bridging the gap at the platform door opening, and wherein the moveable threshold is coupled for movement in conjunction with opening and closing movement of said platform door in the barrier.

2. A combination as claimed in claim 1, wherein the withdrawn position of the moveable threshold is a position beneath a fixed threshold of the platform and the extended position of the moveable threshold is a position in which it forms an extension of said fixed threshold.

3. A combination as claimed in claim 2, wherein in an extended position forming an extension of the fixed threshold, the movable threshold is substantially flush with the fixed threshold.

4. A combination as claimed in claim 3, wherein the movable threshold comprises a tilting mechanism for moving said movable threshold from an extended position substantially flush with the fixed threshold to beneath the fixed threshold in a withdrawn position.

5. A combination as claimed in claim 4, wherein said tilting mechanism comprises a pivoting arm, tie rod and link mechanism between the platform and the movable threshold for reciprocating the movable threshold between extended and withdrawn positions, and a guide pin and guide arrangement that supports the movable threshold and that guides the movable threshold during its reciprocating travel.

6. A combination as claimed in claim 3, wherein the movable threshold is hinged to the fixed threshold for pivoting said movable threshold down from an extended position substantially flush with the fixed threshold to a withdrawn position.

7. A combination as claimed in claim 2, wherein said platform has a base level beneath said platform edge, and wherein the movable threshold is supported by pivotable arms upstanding from the base level of the platform, pivotable movement of these arms swinging the moveable threshold from an extended position to a withdrawn position and vice versa.

8. A combination as claimed in 1, wherein there are a plurality of said moveable thresholds supported by the platform and said barrier has a plurality of said platform doors in it, the moveable thresholds in their extended positions bridging gaps at the platform door openings, the moveable thresholds being coupled for movement in conjunction with opening and closing movement of said platform doors in the barrier.

9. A combination as claimed in claim 8, wherein said moveable thresholds are arranged in groups, said control means including means for controlling movement of each group of moveable thresholds via their moving means individually from each other group of moveable thresholds.

10. A combination as claimed in claim 1, wherein said moving means comprises an electric actuator.

11. A combination as claimed in claim 10, wherein said electric actuator comprises a synchronous AC motor.

* * * * *